US005429494A

United States Patent [19]

Kuehn

[11] Patent Number: 5,429,494

[45] Date of Patent: Jul. 4, 1995

[54] LOW PRESSURE TRANSPORTABLE IGNITING DEVICE USING VOLATILE LIQUID FUEL

[75] Inventor: Scott L. Kuehn, Missoula, Mont.

[73] Assignee: Plum Creek Timber Co., L.P., Seattle, Wash.

[21] Appl. No.: 130,353

[22] Filed: Oct. 1, 1993

[51] Int. Cl.[6] ..... F41H 9/02

[52] U.S. Cl. ..... 431/91; 431/2; 126/271.2 R; 126/271.2 C

[58] Field of Search ..... 431/91, 2; 126/271.1, 126/271.2 R, 271.2 C

[56] References Cited

U.S. PATENT DOCUMENTS

| | | | |
|---|---|---|---|
| 1,340,012 | 5/1920 | Cave et al. . | |
| 2,331,388 | 10/1943 | Graham | 431/91 |
| 2,417,981 | 3/1947 | Graham . | |
| 2,601,893 | 7/1952 | Funke . | |
| 2,851,094 | 9/1958 | Griffin | 431/91 |
| 2,971,573 | 2/1961 | Griffin et al. . | |
| 3,872,769 | 3/1975 | Rosling | 431/91 |
| 4,247,281 | 1/1981 | McGrew et al. . | |

*Primary Examiner*—Larry Jones
*Attorney, Agent, or Firm*—Stephen M. Evans; David L. Garrison

[57] ABSTRACT

A transportable igniting device utilizing burn fuel especially ,adapted for use in forestry management practices is disclosed. The invention has a fuel storage tank which is fluidly coupled to a pressurizing assembly which includes; a pump and a pressure fuse which is in turn coupled to an application wand having igniting means associated therewith. The pump removes fuel from the tank and delivers it to the pressure fuse. The pressure fuse remains open during normal operation but interrupts fuel flow if line pressure varies from predetermined parameters. The fuel expelled from the application wand is ignited by the igniting means and is delivered to a distant target. Features of the invention provide for a hose to couple the pressurizing assembly to the application wand so that the wand may be distant from the assembly. In addition, a bypass valve may be located fluidly intermediate the pump and the pressure fuse to return unused fuel to the tank, thus creating a continuously cycling pressurizing assembly. Safety features associated with a preferred embodiment include multiple flashback prevention means in the form of check valves and loops formed in the application wand. The invention is also suitable for portable use when using a separate gasoline motor to cause the pump to pressure the fuel.

18 Claims, 5 Drawing Sheets

LOW PRESSURE TRANSPORTABLE IGNITING DEVICE USING VOLATILE LIQUID FUEL

FIELD OF THE INVENTION

The present invention relates to incendiary devices or flame throwers and more particularly to transportable igniting devices utilizing generally volatile liquid fuel for use in forestry practices such as timber slash burning.

BACKGROUND OF THE INVENTION

In the art of flame throwing type devices, there are two predominant applications: flame throwers directed to military uses and flame throwers directed to timber management uses. While the general goal of all flame throwers is to create a device which can project a burning flammable substance that will cause a target to burn, each application has its own special needs. In the art of timber management, it is desirable to have a high capacity device that can deliver a large amount of ignited but unburned fuel to the targeted material so as to create and sustain a burn. Therefore, like military applications, sustained burning of the expelled flammable substance, once in contact with the targeted material, is most desirable.

Sustained burning capacity (or high residual heat) of a flammable substance is usually associated with those substances having low volatility or ignition points, e.g. high molecular weight hydrocarbons. Unfortunately, many of those flammable substances or fuels having low volatility are generally not easily ignited. Solutions to this problem have been proposed. For example, aeration of the fuel prior to ignition has been claimed to result in increased burn Characteristics while still maintaining appropriate sustained burning capacity. Another example has been to construct devices that use gelatinized gasoline. While the aeration of fuel solutions are inexpensive and simple, they have a limitation: in that the introduction of increased amounts of oxygen per unit fuel may be insufficient to create continued burning of the dispensed fuel, especially upon contact with and residence upon the targeted material. The performance of devices that use gelatinized fuel suffers when operating the device in cold temperatures. Furthermore, these devices, which necessitate mixing in a relatively costly additive such as aluma gel, require special preparation of the fuel and device prior to and during use. For example, the manufacturer of a transportable flame thrower that uses gelatinized gasoline recommends that the fuel be mixed 5 to 20 minutes prior to use. Moreover, these devices generally require specialized high pressure pumps and are of considerable weight.

SUMMARY OF THE INVENTION

The present invention overcomes these and other problems by increasing the volatility of the expelled fuel and providing redundant safeguards to prevent accidental explosions due to the nature of the fuel, By so doing, the invention provides a low cost igniting device that can use common equipment and is light weight, and easy to operate. The invention is directed towards a cycling flame throwing device comprising a fuel storage tank fluidly coupled to a pump, at least one safety assembly, and an application wand. The pump has an inlet that is fluidly coupled to the tank and delivers pressurized fuel, via an outlet, to a bypass valve and a pressure fuse. The bypass valve insures that fuel will be returned to the tank when a line pressure in excess of a predetermined valve is reached. The pressure fuse has a determinable operating range wherein a variance in operating pressure beyond a preset level at either an inlet or an outlet, causes the flow of pressurized fuel at the outlet immediately to cease. Fluidly coupled to the pressure fuse outlet is the application wand which has an on-off valve for controlling the flow of pressurized fluid. Integral with the wand, in a preferred embodiment, is at least one anti-flashback component to further reduce the risk of an accidental explosion.

Because the present invention preferably uses liquid combustible fuels having a vapor pressure greater than that of diesel fuel and a viscosity less than that of gelatinized gasoline, additional safety components of the flame thrower are desirable. Therefore, in a preferred embodiment, one or more anti-flashback loops are formed in the wand. These loops cause the liquid fuel to settle in a portion of the wand, regardless of the wand's orientation, thus forming a vapor barrier much in the way that a drain trap creates a vapor barrier to sewer gas. Consequently, this vapor barrier reduces the likelihood of a vapor flashback. A preferred embodiment also incorporates a ball check valve which isolates upstream components from explosion should a flashback occur.

Additional structure of a preferred embodiment includes a hose and a hose reel intermediate the pump and the wand so that the wand may isle operated remotely from the tank and pressurizing components. The reel preferably has a self-recoiling mechanism which assists in wrapping an extended section of the hose. The reel also has at least one rotatable fluid union so as to eliminate hose twist during operation of the reel.

These and other features of the invention will become more apparent upon inspection of the drawings and the Detailed Description of the Invention.

DETAILED DESCRIPTION OF THE INVENTION

Figure 1:
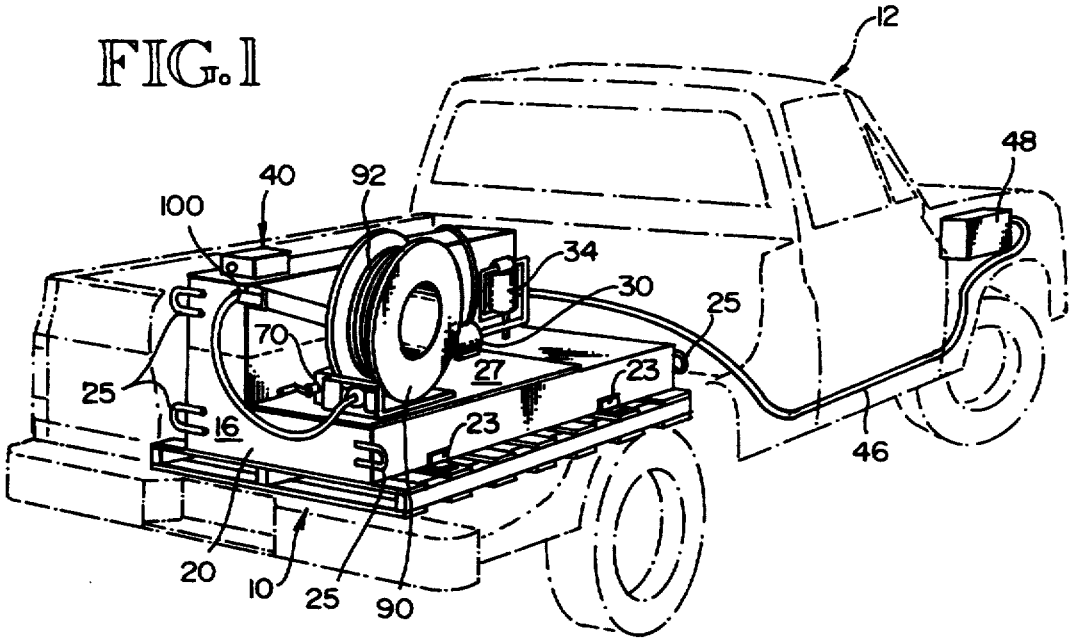
FIG. 1 is a perspective view of the flame throwing assembly residing in a light truck which is shown in phantom.
Figure 2:
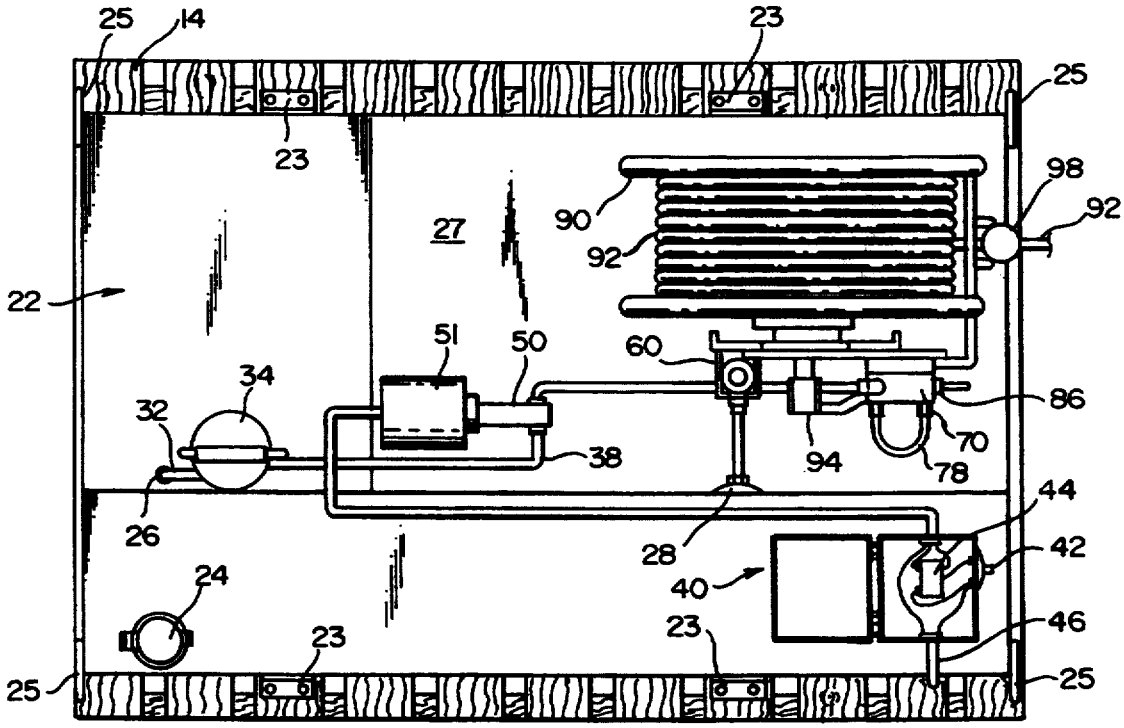
FIG. 2 is a plan view of a fuel tank mounted to a pallet having a pressurizing assembly, an electrical control box, a bypass valve, a pressure fuse, and a hose reel.

Reference is now made to the several Figures wherein like numerals indicate like parts. As best shown in FIGS. 1 and 2, a preferred flame throwing assembly 10 for use in forestry practices comprises fuel storage assembly 20, pressurizing assembly 30, electrical control box 40, bypass valve 60, pressure fuse 70, hose reel 90 having main hose 92, and application wand 100. Flame throwing assembly 10 is designed to contain and expel burn fuel 16 (generally comprising a 50—50 diesel/-gasoline mixture and shown in phantom) a distance of about 40 horizontal feet although simple modifications to pump pressure and nozzle orifice can alter this value. The inventor has found that by utilizing this quality of fuel, most limitations of flame throwers in this field can be minimized; by utilizing the embodiment described herein, excellent results and safety can be obtained.

Specifically referring to FIG. 2, fuel storage assembly 20 includes tank 22, filler neck 24, fuel line outlet 26, and bypass inlet 28. Tank 22 is preferably a standard Delta "L"*TM* type 105 gallon slip-in fuel tank constructed from 14 gauge steel although other suitable materials such as aluminum or polyethylene may be used. Because flame throwing assembly 10 is generally transportable by a truck 12 (shown in phantom in FIG. 1 ), a preferred embodiment places all components of flame throwing assembly 10 on tank 22 which may be conveniently mounted to a platform such as pallet 14 by way of L brackets 23 which are permanently attached to the exterior of tank 22. In this manner assembly 10 can be conveniently loaded into or unloaded from truck 12 using, for example, a conventional forklift. Loop brackets 25, also permanently attached to the exterior of tank 22, permit further attachment points for handling flame throwing assembly 10 such as by hoist or crane. Incorporation of these brackets also enable assembly 10 to be carried by a helicopter and activated by remote control as will be discussed below.

In order to adequately support the weight of pressurizing assembly 30, bypass valve 60, pressure fuse 70, hose reel 90 and hose 92, and application wand 100, reinforcing plate 27 is permanently mounted to a suitable horizontal surface of tank 22. Plate 27 is preferably constructed of 3/16 inch plate steel which has been found adequate to support the weight of the aforementioned assemblies and components.

Figure 3:
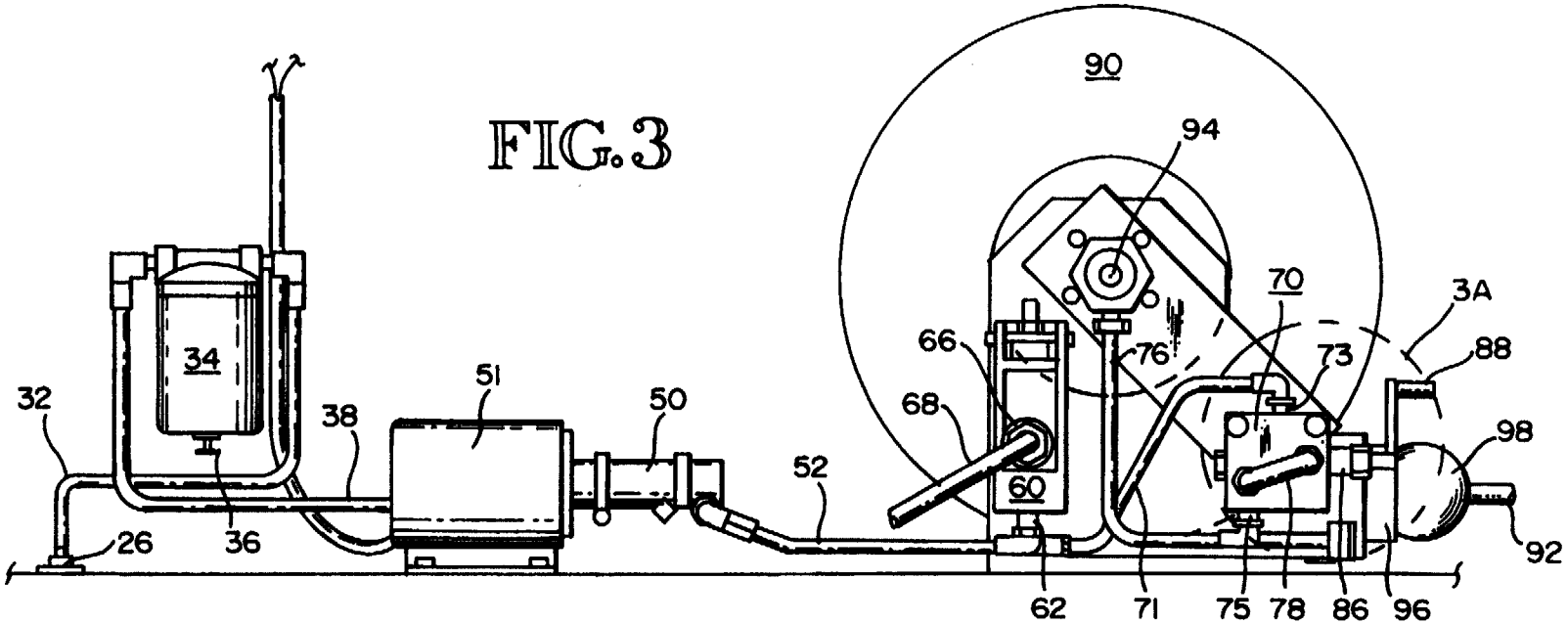
FIG. 3 is a side elevation view of the pressurizing assembly, bypass valve, pressure hose, and hose reel.

Referring to FIGS. 2 and 3, fuel in fuel tank 22 is carried by suction to pressurizing assembly 30 during operation of assembly 10 by way of outlet hose 32. Pressurizing assembly 30 preferably includes filter 34, pump 50, and electrical control box 40. Filter 34 is designed to filter debris and separate water from fuel 16 so as to prevent damage to pump 50. Petcock 36 on filter 34 permits a user to periodically remove separated water from filter 34 to increase its operational life. Pump 50 is connected to filter 34 by way of connecting hose 38. Satisfactory results in experimental use have been obtained when using an Oberdorfer*TM* 12 volt DC ¼ hp explosion-proof pump (model 991 R-50-55-C81).

Electrical control box 40 is preferably constructed to be weather-proof and includes ON-OFF switch 42 mounted to the exterior of box 40, continuous duty solenoid 44 mounted internal to box 40, and power leads 46 extending therefrom.

Activation of pump 50 is preferably carried out by setting switch 42 to the "ON" position. By so doing, solenoid 44 is energized and a closed electrical circuit is created between power source 48, which may conveniently be an automotive type battery and recharging system as shown in FIG. 1, and pump 50. Because flame throwing assembly 10 is light and compact and preferably mounted in an operating vehicle when in use, the need for a separate power source to pressurize the fuel is eliminated, thus further reducing weight and cost.

Integral with pump 50 is a pressure regulating valve (not shown) designed to activate when the pressure in the pump outlet: line exceeds a predetermined value (approximately 65 psi for the aforementioned model). This valve causes fuel 16 to circulate internal to pump 50 when it is operational but no fuel is being expelled by application wand 100. Because pump 50 operates continuously, regardless of whether fuel 16 is being expelled from application wand 100, reliance on the pressure regulating valve associated with pump 50 creates a safety risk in so far as continuously recirculating fuel 16 within pump 50 may over heat, thus increasing the risk of an explosion. Consequently, connecting hose 52 couples pump 50 to inlet port 62 of bypass valve 60. Bypass valve 60 is preferably an explosion-proof valve set to 60 psi having Viton*TM* seals (model number 3/4 200) which are chosen because of their excellent resistance to fuel 16. During operation, fuel 16 is delivered to inlet port 62 and is either directed to an outlet port (not shown) or bypass port 66 where it is returned to tank 22 through bypass hose 68 and bypass inlet port 28 of tank 22. In this manner, should the pressure in connecting hose 52 exceed 60 psi, fuel 16 is directed back to tank 22, thus avoiding fuel recirculation within pump 50 and probable overheating thereof. Moreover, should an operator wish to use gelatinized fuel, this recirculation feature also provides adequate mixing of the fuel provided well known modifications such as increasing hose diameters, volume flows, and operating pressures are carried out.

Downstream of bypass valve 60 and fluidly connected there to by connecting hose 71, is pressure fuse 70. Pressure fuse 70, which is shown in an enlarged, cross section in FIG. 3A and in FIG. 3B, includes the following elements shown in phantom: manifold 72, inlet port 73, outlet port 75, and equalizing tube 78 which is coupled to equalizing ports 77 and 79. Internally, pressure fuse 70 has directional valve 80 which is housed in chamber 81. Directional valve 80 has two main sub-assemblies, namely cage 82 which contains ported spool 84, and, tension spring 83 which is connected at one end to spool 8A and at another end to retaining cap 85. Depending from the exterior of pressure fuse 70 into chamber 81 is manually depressible plunger 86 (shown in phantom in FIG. 3A) which acts on ported spool 84 to cause it to vary the length of the spring 83 when handle 88 is rotated, thereby regulating fluid flow between inlet port 73' and outlet port 75' via orifices 73' and 75.

Figure 3A:
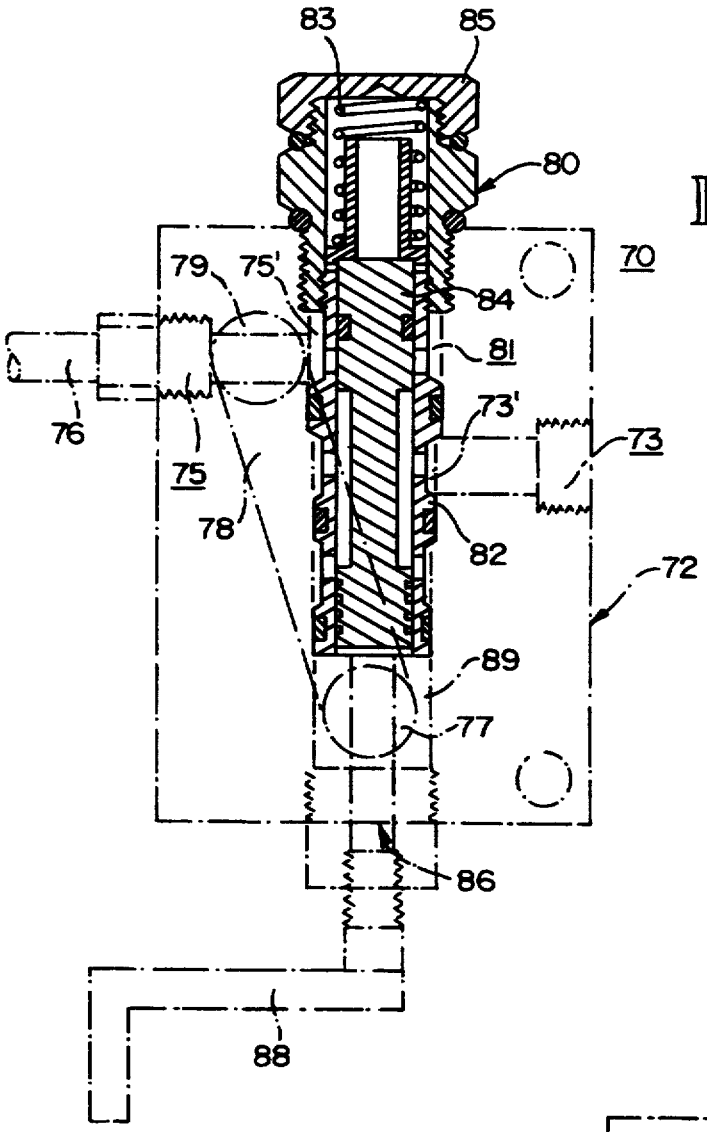
FIG. 3A is a cross sectional view of the pressure fuse shown in FIG. 2 where the fuse is in a closed state and the manifold and plunger assembly are shown in phantom.
Figure 3B:
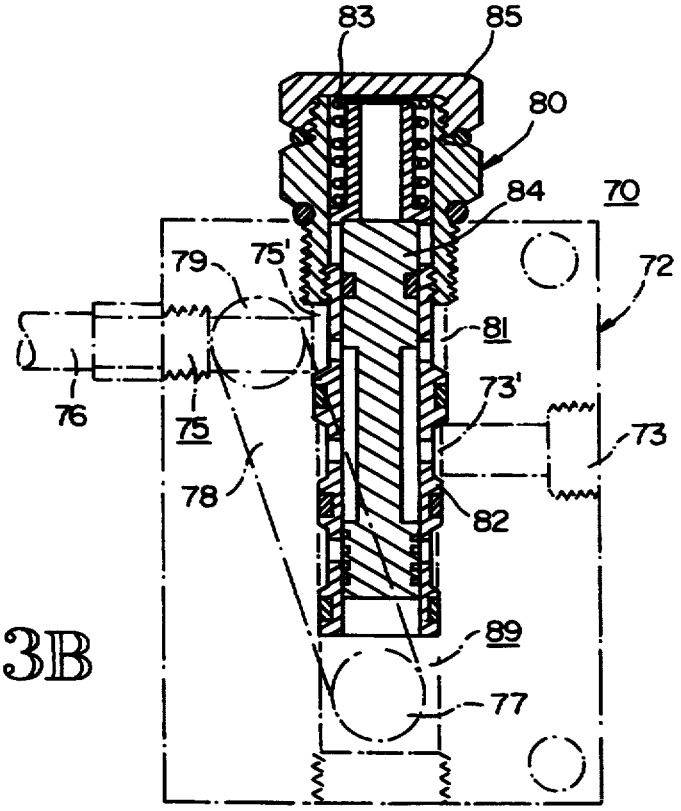
FIG. 3B is a cross sectional view of the pressure fuse as substantially shown in FIG. 3A but where the fuse is shown in an open state and the plunger assembly is removed for clarity.

FIG. 3A shows pressure fuse 70 in a closed or non-flow state. There is no fluid path between inlet port 73 and outlet port 75. In order to achieve fluid flow between these two ports, spool 84 must be urged towards retaining cap 85. To overcome the compressional resistance of spring 83, handle 88 of plunger assembly 86 is rotated, thus causing spool 84 to compress spring 83 and create a fluid path between inlet port 73 and outlet port 75 as best shown in FIG. 3B. Having established such a fluid path, fluid can enter connecting hose 78 at outlet port 75 and pressurize a portion of chamber 81 designated as portion 89. Once pressurized, ported spool 84 is held in an open position by the pressurized fluid in portion 89 and plunger assembly 86 can be returned to its initial position. As long as sufficient pressure exists in portion 89, fluid will flow through outlet house 76.

Pressure fuse 70 is designed to permit fluid flow between inlet and outlet ports 73 and 75 only if the fuel pressure is within certain parameters, i.e. fuel pressure below a predetermined value (as primarily determined by the spring constant of spring 83) causes spool 84 to deviate from its equalized position which causes the fluid flow between inlet port 73 and outlet port 75 to close. In a preferred embodiment, pressure fuse 70 will cause spool 84 to close when fuel pressure drops more than 5 psi from the predetermined value of 60 psi. Thus, should any pressure hose or fitting fail while pump 50 is operating, pressure fuse 70 will automatically interrupt fuel supply to application wand 100.

Those persons skilled in the art will appreciate that various forms of pressure fuses may exist. The present embodiment was designed for simplicity and reliability. Modifications to pressure fuse 70 include utilizing an electric solenoid controlled by a timed relay switch which is activatable by switch 42 to temporarily position spool 84 prior to energizing pressure fuse 70. In this manner, an operator need only turn switch 42 to the "ON" position to activate the flame throwing assembly. In this variation, an operator of the invention can be situated remote from the pressurizing assembly.

Returning again to FIGS. 3 and 4, connected to outlet port 75 is outlet hose 76 which in turn terminates at rotatable union 94; of reel 90. Rotatable union 94 permits fuel 16 to enter main hose 92. Reel 90 is preferably a spring loaded return type which has a storage capacity of 150 feet of % inch diameter hose. Main hose 92 is characterized as a 3/8 inch diameter abrasion resistant, fuel compatible type. It is fluidly coupled to a second rotatable union (not shown) at a proximal end and coupled to application wand 100 at a distal end. To prevent over-retraction of main hose 92 on reel 90, hose 92 passes through fairlead 96 and has attached on its distal end near wand 100 ball stop 98. This combination advantageously prevents undesired over-retraction of hose 92 on reel 90.

Figure 4:
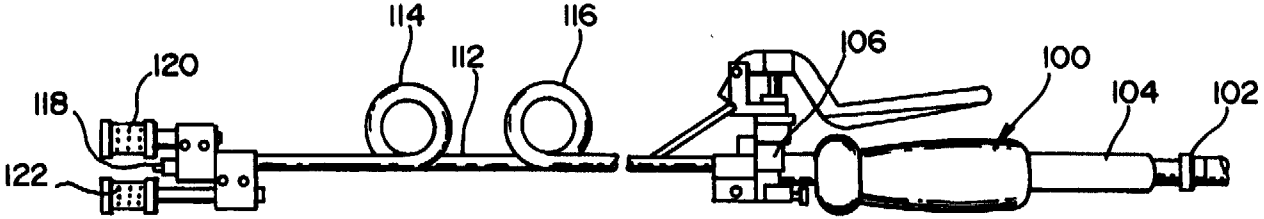
FIG. 4 is a side elevation view of an application wand including several anti-flashback components.

Specifically referring to FIG. 4, application wand 100 includes connector 102, check valve 104 to further reduce the possibility of flashback, depressible ball valve 106 having an internal flashback protector, brass pipe 112, nozzle 118, and wicks 120 and 122. Ball valve 106 is a standard gas ball valve that is preferably modified to have Viton$^{TM}$ seals which are more suitable for use with fuel 16. Brass pipe 112 is preferably constructed from 3/8 inch diameter thick wall brass tubing. Anti-flashback loops 114 and 116 are formed in pipe 112 for additional flashback protection. By including loops 114 and 116, fuel 16 is constantly trapped in at least one portion of each loop, thus creating a vapor barrier which is known in the art to reduce the incidence of flashback explosions.

Nozzle 118 is preferably replaceable to: enable a user to select the appropriate nozzle for each application: larger diameter nozzles being more :suitable for application of larger quantities of fuel and smaller diameter nozzles being more suitable for application of fuel to more distant L targets. Nozzle 118 is preferably threadable into the distal portion of wand 100.

Wicks 120 and 122, which are typical for devices of the invention, provide the ignition source for fuel 16. Each wick is self Sustaining upon closure of ball valve 106, the residual fuel pressure in pipe 112 causes a small dribble; of fuel to exit nozzle 118 and drop on to either wick 120, wick 122, or both. Thus, wicks 120 and 122 are intermittently replenished with fuel and obviate the need for a dedicated and often complex ignition circuit such as exists in the art.

OPERATION OF THE INVENTION

Figure 5:
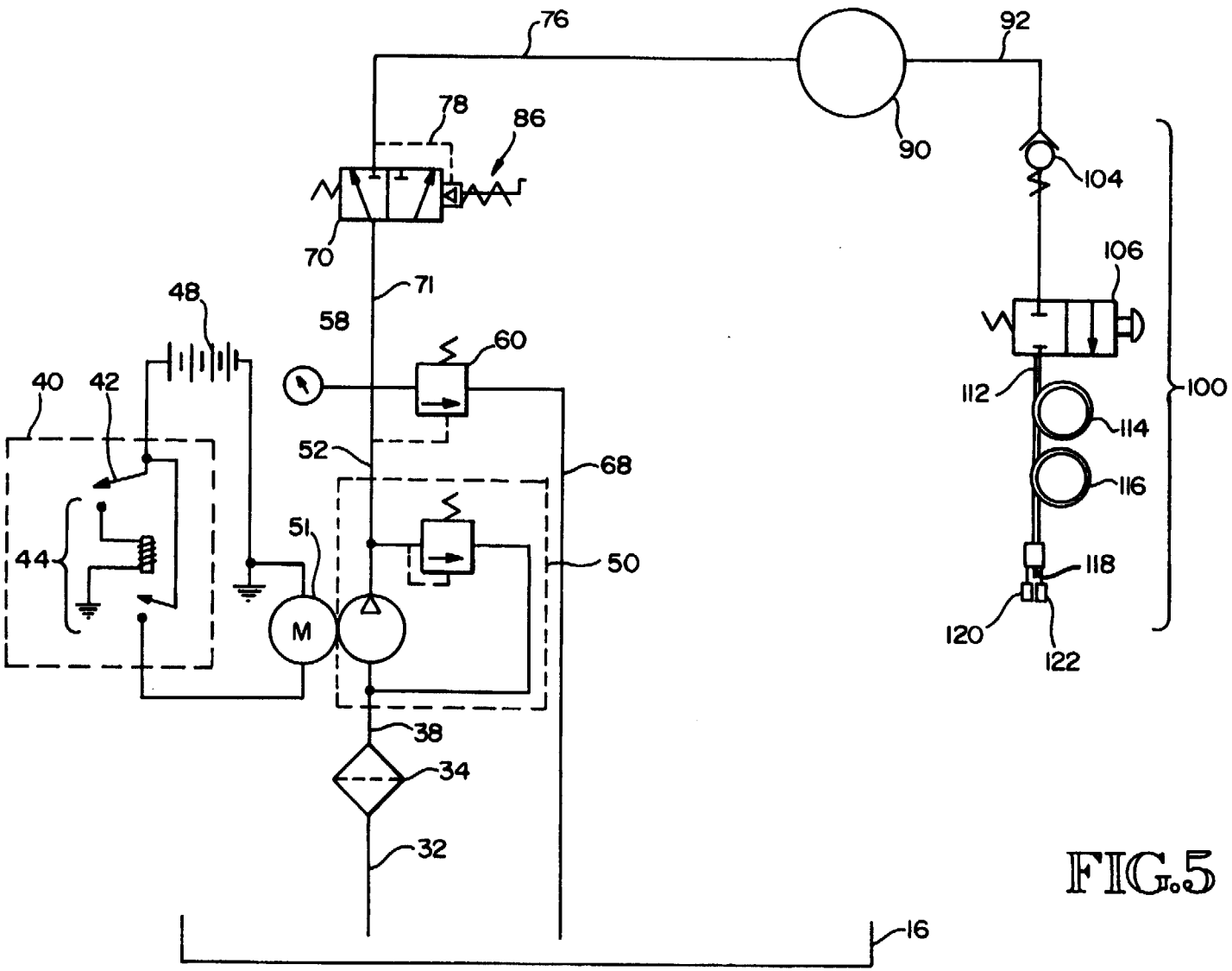
FIG. 5 is a schematic diagram of the fuel flow pattern and electrical circuit of a preferred embodiment.

Because of the lightweight nature of the invention and its simplicity, it is amenable to a variety of applications. As previously described, a preferred embodiment of the invention, as shown in the several drawings, may be secured to a pallet and located in a vehicle. An operator need only pre-load ported spool 84 of pressure fuse 70 such as by rotating handle 88 of plunger assembly 86 and activate switch 42 of electrical control box 40 to make the device operational. Once the line pressure has reached its operating level as indicated by gauge 58 (see FIG. 5), the line pressure created by pump 50 should cause pressure fuse 70 to remain open. Therefore, plunger assembly 86 can be returned to its initial position. Thereafter, either both wicks 120 or 122 or both may be ignited and application of fuel 16 to the targeted materials can be accomplished by controlling ball valve 106 of application wand 100.

Should remote operations of the invention be desired, for example, while being carried by a helicopter, switch 42 can be located remote from electrical control box 40 and manually operable plunger assembly 86 can be replaced by a suitable solenoid which would preferably be controlled by a timing relay or circuit linked to switch 42. In addition, ball valve 106 also can be replaced by a suitable solenoid to control valve 106 so as to make it remotely operable. In such an application, there would be no need for hose reel 90 and application wand 100 could be fixedly attached to tank 22.

Figure 6:
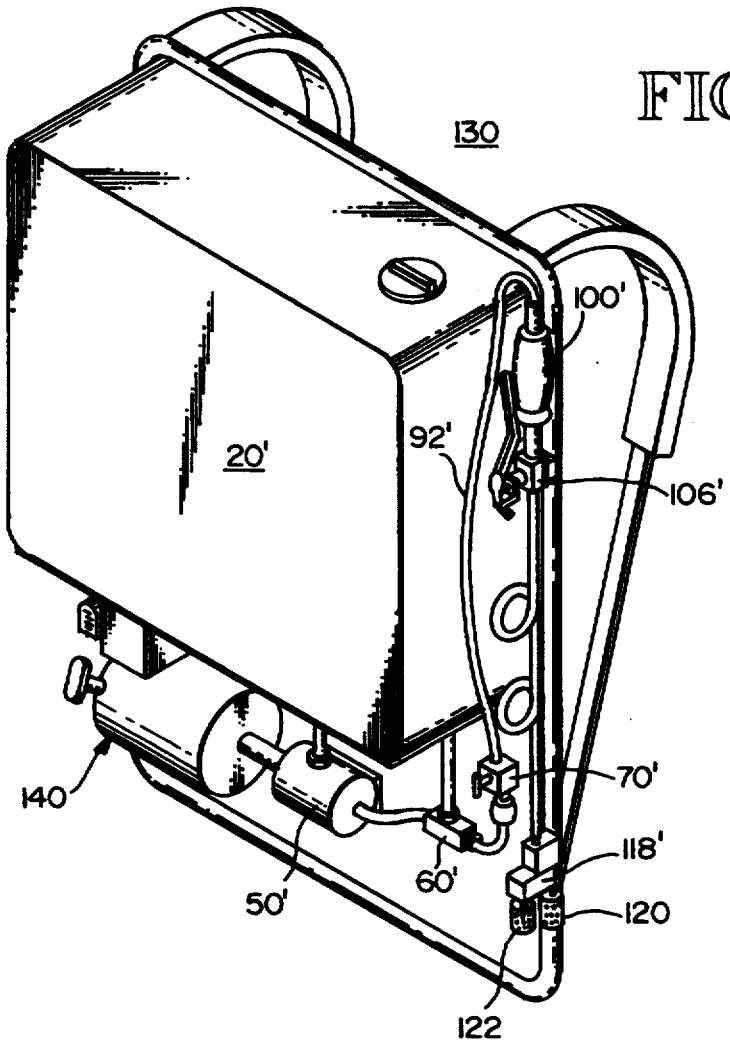
FIG. 6 is an elevation view of a portable embodiment of the invention showing a fuel tank, a pressurizing assembly, a bypasss valve, a pressure fuse, a hose, and an application wand.

Because the present invention requires: line pressure significantly less than conventional gel fuel type flame throwers, pump 50 can be extremely compact and lightweight. Hence, the present invention can easily be modified in such a manner so as to be carried by an individual for use in remote locations. Such an embodiment is shown in FIG. 6 and is mounted to frame-type back pack 130. General modifications to the basic invention as described above include use of light weight baffled fuel tank 20', having a volume of approximately 5 to 8 gallons use of a smaller and mechanically driven pump 50', use of a portable power source such as motor 140, and incorporation of generally smaller diameter and weight hoses and fittings.

Motor 140, which is preferably gasoline powered, can be a recoil starting type and connected directly or indirectly by reduction gears to pump 50'. Because bypass valve 60 returns unused fuel to fuel tank 20', it can be set at maximum throttle, thus obviating the need for additional components such as a line pressure sensitive throttle actuator or clutch assembly which may make the device unreliable and/or heavy. In this manner, maximum pressure is always available to the operator and the need for restarting the motor is all but nonexistent since it is continuously operating at maximum throttle. The remaining components shown in FIG. 6 are smaller versions of those components shown in FIGS. 1 through 4 and are designated with a prime (').

What is claimed:

1. A transportable flammable fuel igniting device comprising:

a fuel tank;

an application wand having a nozzle at one end for dispensing fuel;

a pump in fluid connection with the fuel tank and the application wand whereby the pump removes fuel from the fuel tank and delivers it, under pressure, to the application wand;

a pressure fuse fluidly intermediate to and coupled with the pump at an inlet port and the application wand at an outlet port whereby the fuse interrupts the flow of fuel to the outlet when the pressure of the fuel deviates from preselected tolerances; and means for igniting the fuel at the nozzle.

2. The device according to claim 1 further comprising a bypass valve fluidly intermediate the pump and the application wand whereby fuel is returned to the tank when fuel pressure exceeds a predetermined value.

3. The device according to claim 1 further comprising a filter fluidly intermediate the tank and the pump whereby impurities in the fuel are removed from the fuel prior to entering the pump.

4. The device according to claim 1 further comprising a hose fluidly intermediate the pump and the application wand.

5. The device according to claim 4 further comprising a hose reel whereby the hose may be stored.

6. The device according to claim 1 wherein the application wand further comprises a flow regulating valve fluidly intermediate the hose and the nozzle.

7. The device according to claim 1 wherein the application wand further comprises at least one flashback preventer.

8. The device according to claim 7 wherein the at least one flashback preventer is, a check valve.

9. The device according to claim 7 wherein the at least one flashback preventer is a loop formed in the wand.

10. The device according to claim 1 wherein the means for igniting the fuel is a spark generating apparatus.

11. The device according to claim 1 wherein the means for igniting the fuel comprises a hydrocarbon fuel circuit having a pilot light.

12. The device according to claim 1 wherein the means for igniting the fuel is at least one wick wherein the wick is generally continuously burning during operation of the device.

13. The device according to claim 1 further comprising a bypass valve fluidly intermediate the pump and the application wand whereby fuel is returned to the tank when fuel pressure exceeds a predetermined value;

a hose fluidly intermediate the pump and the application wand;

a flow regulating valve fluidly intermediate the hose and the nozzle; and at least one flashback preventer integral with the application wand.

14. The device according to claim 13 wherein the means for igniting the fuel comprises at least one wick.

15. The device according to claim 13 further comprising a hose reel having a fairlead and a self recoil mechanism, and whereby a ball stop securely attached to the hose wherein the hose passes through the fairlead and the ball stop prevents overwinding of the hose on the hose reel.

16. A pressure fuse to interrupt fluid flow in devices for transporting pressurized fluids when presented with a fluid pressure drop below a predetermined level comprising:

a manifold having a chamber coupled to an inlet port and an outlet port wherein the inlet port is coupled to a fluid source and the outlet port is coupled to a dispenser;

a ported spool and cage positioned in the chamber whereby the spool controls fluid flow between the inlet and outlet ports;

means for biasing the spool whereby in an unpressurized state the means for biasing the spool causes the spool to prevent fluid flow between the inlet port and the outlet port; and an activatable plunger assembly linked to the spool whereby the activatable plunger assembly preloads the spool to negate the means for biasing the spool so as to permit fluid flow between the inlet port and the outlet port regardless of whether a pressurized fluid is present in the chamber.

17. The pressure fuse according to claim 16 wherein the device is an igniting device.

18. A method for igniting a distant target comprising the steps of:

a) filling a tank with burn fuel;

b) negating a bias associated with a pressure fuse so as to permit fluid flow therethrough;

c) pumping the fuel through the pressure fuse;

d) restoring the bias associated with the pressure fuse;

e) directing the fuel to the distant target; and f) igniting the fuel.

* * * * *